United States Patent [19]

Bauer et al.

[11] Patent Number: 4,644,622

[45] Date of Patent: Feb. 24, 1987

[54] APPARATUS FOR AIR ENTANGLING A PLURALITY OF ADVANCING YARNS

[75] Inventors: Karl Bauer; Michael Hanisch, both of Remscheid, Fed. Rep. of Germany

[73] Assignee: Barmag Barmer Maschinenfabrik AG, Remscheid, Fed. Rep. of Germany

[21] Appl. No.: 720,139

[22] Filed: Apr. 5, 1985

Related U.S. Application Data

[63] Continuation-in-part of Ser. No. 676,723, Nov. 30, 1984, Pat. No. 4,592,119.

[30] Foreign Application Priority Data

Feb. 18, 1984 [DE] Fed. Rep. of Germany ..... 3405891
Apr. 7, 1984 [DE] Fed. Rep. of Germany ..... 3413276

[51] Int. Cl.[4] ..... D02G 1/16; D02J 1/08

[52] U.S. Cl. ..... 28/271; 28/172; 28/272; 28/274

[58] Field of Search ..... 28/271, 272, 274, 275, 28/276, 172; 57/350

[56] References Cited

U.S. PATENT DOCUMENTS

| | | | |
|---|---|---|---|
| 3,022,566 | 2/1962 | Daniels et al. | 28/271 X |
| 3,134,158 | 5/1964 | Marks, Jr. | 26/3 |
| 3,261,071 | 7/1966 | Clendening, Jr. et al. | 28/272 |
| 3,324,526 | 6/1967 | Burns et al. | 28/271 |
| 3,353,344 | 11/1967 | Clendening, Jr. | 28/272 X |
| 3,367,100 | 2/1968 | Hughey | 28/276 X |
| 3,537,248 | 11/1970 | Berg et al. | 28/275 X |
| 3,555,808 | 1/1971 | Gutmann, Jr. | 28/271 X |
| 3,659,350 | 5/1972 | McCullough | 28/274 X |
| 3,822,449 | 7/1974 | Dick | 28/272 |
| 4,068,358 | 1/1978 | Luther | 28/272 |
| 4,223,520 | 9/1980 | Whitted et al. | 28/276 X |

FOREIGN PATENT DOCUMENTS

| | | |
|---|---|---|
| 2611547 | 9/1977 | Fed. Rep. of Germany . |
| 1576355 | 10/1980 | United Kingdom . |

*Primary Examiner*—Robert R. Mackey
*Attorney, Agent, or Firm*—Bell, Seltzer, Park & Gibson

[57] ABSTRACT

An apparatus is disclosed for simultaneously air jet entangling a plurality of advancing multifilament yarns. The apparatus includes a plurality of elongate air jet beams, with each beam having a longitudinal air passageway extending along its length, and at least one row of closely spaced air jet nozzle heads supported along each of the beams. Each of the nozzle heads includes a plurality of individual yarn entanglement nozzles and a central air chamber connecting the central air chamber to the air passageway. Also, an air jet aperture communicates between the air passageway and the yarn duct of each entanglement nozzle for directing an impinging airstream against an advancing yarn passing through the duct. The beams are mounted for adjustment on a supporting frame so that the nozzle heads may be positioned in proper alignment with a sheet of yarns passing therethrough. The beams may be rectangular or round in cross section and the nozzle heads are releasably connected along the length of the beams. An enclosure suction box surrounds the beams and removes the air exhausted from the entanglement jets and acts to insulate the noise of the entanglement jets.

31 Claims, 24 Drawing Figures

APPARATUS FOR AIR ENTANGLING A PLURALITY OF ADVANCING YARNS

The present application is a continuation-in-part of our copending application Ser. No. 676,723. filed Nov. 30, 1984, now U.S. Pat. No. 4,592,119 granted June 3, 1986 and entitled AIR JET YARN ENTANGLING APPARATUS.

This invention relates to an apparatus for simultaneously air entangling a plurality of advancing yarns as well as to an air jet beam for use in such an apparatus.

When drawing multifilament yarns of thermoplastic materials, such as polyamides, polyester, polypropylene, and polyethylene, it is desirable that the yarns be subjected to air entanglement before or after the drawing operation. In such cases, an air jet is directed transversely upon each running yarn. The air jet causes a geometric relocation of the individual filaments so that the filaments receive a certain cohesion among themselves. As a result, this process has also been designated as interlacing, and is generally referred to by the description "entangling."

In the drawing of warp sheets of such multifilament yarns, in which for example a thousand or more yarns are withdrawn from a creel, guided to a common plane, and concurrently drawn between several rolls, there exists the problem of arranging an adequate number of air jet nozzles before the drawing operation or subsequently to same, if this is desired.

German Auslegeschrift DE-AS No. 26 11 547 and corresponding British Pat. No. 1,576,355 disclose an apparatus for air entangling a warp sheet of yarns, in which the entanglement nozzles are sealably mounted in a flat housing and connected to a common source of air. A nozzle plate is arranged in a vertical plane, so that the air nozzles are directed essentially horizontally. However, the apparatus has the disadvantage that it produces in part yarns with unsatisfactory entanglement, and in part a warp sheet of nonuniform quality. As a result, the present invention is based on the recognition that the yarn guidance in the nozzle substantially influences the quality of the yarn and particularly the quality of the entanglement.

It is therefore an object of the present invention to provide an air jet entangling apparatus for a warp sheet of yarns which is supplied from a plurality of horizontal and vertical planes, and which is able to create essentially uniform entangling conditions for each yarn while passing through the corresponding air entanglement nozzle.

This object is accomplished by an apparatus of the above-described type which is characterized in that a single supporting frame accommodates a plurality of nozzle heads each containing several air entanglement nozzles, the position of which is variable relative to each other and to the warp sheet. Advantageously, the nozzle heads are constructed as hollow bodies, and the hollow spaces are connected by air channels of the individual entanglement nozzles of each nozzle head to a source of compressed air. An advantageous embodiment is characterized in that the entanglement nozzles are arranged on a plurality of horizontal air jet beams, and that the beams are adapted to rotate separately from each other about a horizontal axis.

To begin with, it has been found that the quality of the entanglement is also dependent on the fact that the yarn, as seen in the longitudinal section of the nozzle duct, passes diagonally through the entangling nozzle. The invention makes it possible to adjust each air jet beam so that this condition is present. In addition, each beam may be preceded and/or followed by a yarn guide bar which extends along the beam and defines the yarn path within the nozzles. These yarn guide bars may advantageously be connected with the beam and accordingly are adapted to pivot with the same.

A preferred embodiment of the invention provides that the supporting frame in which the individual air jet beams are pivotally arranged, is itself adapted to pivot about a horizontal axis. This arrangement permits a further adjustment of the yarn paths through the respective yarn entanglement ducts through adjustment of the beam. Further, the present apparatus may also effect a relatively slight deflection of the yarn during its passage through the entanglement duct, so that the differences in the traveling length of the yarns preceding and following the apparatus are relatively slight between nip points. Also, the pivotal mounting of the supporting frame facilitates the initial insertion of the individual yarns. The air jet beams may be connected with a source of compressed air by means of hoses.

A rugged and constructionally simple design is made possible in that at least one of the vertical side portions of the frame is constructed as a hollow section and connected to the compressed air system, the individual air jet beams being connected to the hollow section, preferably by means of hollow pivotal shafts. In this embodiment, external air connections are avoided and this is advantageous because such external air connections can be a hindrance when a plurality of yarns are to be threaded and guided. The air to the frame is preferably supplied in the lower traverse portion which, in this case, is also hollow in cross section.

An advantageous design of an air jet beam which is particularly adaptable for use in such an apparatus includes an upwardly directed planed and smooth surface on which a cover beam is placed with a congruent planed and smooth lower surface. Yarn guide grooves extending vertically to the longitudinal axis of the yarn are cut into one of the two surfaces. When the cover beam is raised, one yarn can be easily inserted into each of these grooves. By covering the grooves with the cover beam, each groove forms an all-enclosed yarn duct. Each groove is connected by means of a tap line to an air duct which extends in a longitudinal direction along the air jet beam, and which, for example, is supplied with compressed air.

The yarn guide ducts may be in the form of rectangular grooves, which are milled into the plane surface of the air jet beam. This has the advantage that the cover beam needs no further machining aside from the planing of its smooth lower surface. However, yarn guide grooves can also be cut into both plane surfaces which match with each other when the cover beam is superimposed. In this manner, it is particularly possible to make yarn ducts with a circular cross section, in that the upper surface of the lower beam and the lower surface of the cover beam are fastened tightly to each other, and the nozzle holes are then formed in the seam area of the juncture of the planed surfaces.

It is further possible to cut the grooves into the cover beam. In this case, the lower beam has only a planed smooth upper surface, with tap lines terminating in this surface at the gauge of the grooves machined into the cover beam. A thusly constructed air jet beam makes it possible to arrange the air nozzles very close to each other at a distance of, for example, only 5 mm, so that a relatively small apparatus for individually air entangling on the order of one thousand yarns can be constructed.

In an advantageous embodiment, the tap lines are so arranged that the air stream entering into the yarn ducts can be angled to provide a moving component in the direction of advancement of the yarns. Thus, when the air entangling apparatus is arranged behind the draw system, an advantage is obtained because the entangling nozzles exert a traction on the yarn. In the event a yarn breaks in the area of winding, the yarn is therefore further advanced, without having to rethread the broken end into the nozzle in which the broken end is present.

In another embodiment of the invention, a row of air jet nozzle heads is attached to an essentially horizontally extending air supply beam, with each air jet nozzle head having a number of entanglement nozzles including yarn ducts which extend parallel to each other, and the air channels of which are connected with a common air supply. The individual entanglement nozzles may be arranged in the nozzle heads in one or several rows parallel to each other, with the planes parallel to each other extending through the nozzle axes of the individual row in essentially perpendicular relationship to the air supply beam. Each individual air jet nozzle head includes at least four, and preferably at least six, individual entanglement nozzles which are arranged very close together and with very short distances between the yarn ducts. The distance between two neighboring yarn ducts is preferably as small as 1.5 mm and is no more than about 15 mm, it being possible to stagger the yarn ducts of neighboring rows, for the purpose of reducing the space between rows, when the yarn ducts are positioned in several parallel rows. In a specifically disclosed embodiment, an individual air jet nozzle head consists of a housing and an insert fitted into the housing for accommodating the individual entanglement nozzles.

The air channels or ducts of the individual entanglement nozzles of an air jet nozzle head are connected to a common air supply in the air jet nozzle head. The entanglement nozzles may be formed in the inserts and may be arranged in up to six rows, with the rows of nozzles being positioned in planes parallel to each other and essentially perpendicular to the air supply beam. Air may be supplied through hollow spaces between an insert and the inside wall of the housing and/or a hollow space in the center of an insert. The insert may also consist of at least two parallel plates, each accommodating one or two rows of entanglement nozzles, with grooves being provided for the supply of air to the air channels, which grooves are cut into at least a portion of the plates.

In another, further disclosed embodiment, the nozzle head is a hollow box. It contains bores in its side walls transversely extending to the yarn path, which bores serve to receive closely spaced insertible tubular nozzles, which are fitted with their ends into the bores of the side walls. The insertible tubular nozzles include air channels which communicate with the interior of the box.

In one specific embodiment of this further development of the invention, the rows of inserted nozzles are staggered relative to each other by half the space between two adjacent inserted nozzles positioned in the same row. The individual inserted nozzles are provided on one end with a rectangular platelet, the edge lengths of which are so adapted that the platelets abut essentially without interspace, when the nozzles are mounted. The rectangular platelets may be asymmetrically offset on their edges to provide a mutual overlap so that it is possible to jointly lock all of the inserted nozzles in position with just one latch plate, and to easily orient them with respect to the position of their air channels or ducts during the assembly.

In another specific embodiment, the nozzle heads have bores in their side walls which extend essentially parallel to the yarn path and which receive insertible nozzles. The bores and the inserted nozzles have threading slots which extend over the length of the inserted nozzles and extend inwardly from the side walls. Air is supplied to the individual nozzle inserts by means of connecting lines extending from the individual bores to the air-carrying interior of the nozzle head. In the operating position, the air channels or ducts and the connecting lines are operatively interconnected. Suitable means may be used for covering the open threading slots in the nozzle head after the yarns have been inserted. The yarn is prevented from exiting the nozzles by rotating the inserts in their bores so that the threading slots are closed. In the latter case, the threading slot and the air bore in the inserted nozzle are so displaced on the inserted nozzle circumference that the air bores are covered by the wall of the bore in threading position, and the threading slots are covered in the operating position.

In a further embodiment, an individual insertible nozzle includes an outer stationary tube with a threading slot which is fixed in the bore of the nozzle head, and an inner member which is adapted to rotate in the tube and includes means for receiving the yarn. The stationary tube further has an air bore which corresponds with the connecting line of the bore in the nozzle head. The inner member may be solid or in the form of a tube. In one embodiment, a yarn guide groove extends along the length of the external surface of the inner member and the groove may be square or rounded in cross section. In another embodiment, the inner member is in the form of a tube provided with an elongated threading slot. When threading a yarn, the inner member is so rotated that its yarn guide groove or slot coincides with the threading slot in the nozzle head and, if necessary, with the stationary tube. In operating position, the yarn guide groove or the inner threading slot is so rotated that it is aligned with the air bore and/or the connecting line to the interior of the nozzle head.

The air supply beam, which is suited to carry the above-described nozzle heads, is mounted on its support frame in such a manner that it can be rotated about its longitudinal axis for purposes of varying the deflection angle of the yarns passing through the entanglement nozzles. One end of the air supply beam is provided with a hollow support shaft supported in the stand and serving as a pivotal bearing. The hollow support shaft may be provided with bores leading to the interior of the beam and communicating with the hollow interior of the stand. The hollow stand is provided with a flange connection for the air supply line, so that air is supplied to the entanglement nozzles by means of the interior of the air supply beam, the bores in the end supported on the hollow stand, and the interior of the stand. In another embodiment, the end of the air supply beam facing the stand extends beyond the stand and is equipped with a flange for connecting the air supply. In a particularly compact embodiment of the apparatus of the present invention, an air supply beam carries two rows of nozzle heads, which are displaced on its circumference by about 180° relative to each other.

The air supply beam with the nozzle heads may be surrounded by an enclosure box which serves as a suction enclosure for removing the air blown from the nozzles and/or for sound insulation. This enclosure box extends outwardly from opposite sides of the nozzles and over a portion of the yarn path. The walls of the enclosure box may be covered on the inside with a sound absorbing material, and the interior portion between the walls may be provided with a suction duct. The suction duct is provided with a plurality of suction orifices, which are preferably rectangular. The suction orifices are each formed by punching three sides of each opening and bending the material inwardly to form a baffle extending at an angle into the suction duct.

In one embodiment the enclosure box encloses two air supply beams extending parallel to each other, each carrying a row of nozzle heads, and with the nozzle heads being substantially directed toward each other. The enclosure box is positioned substantially symmetrical relative to the two rows of nozzle heads. The suction duct is arranged in the center between the two warp sheets associated with the two rows of nozzle heads, and is constructed so that air is equally drawn in through both warp sheets. Advantageously, the parts of the enclosure box extending in front of and behind the rows of nozzle heads are supported for adjustment perpendicularly to the planes of the warp sheets. This adjustment makes it possible to compensate for displacement of the warp sheets relative to each other when the angular position of the nozzles between the yarn entry and yarn exit is adjusted by rotation of the air supply beams.

In a further illustrated embodiment, rows of entanglement nozzles are arranged in parallel relationship and along opposite inwardly tapering sides of each nozzle head. Cover plates are held in position by magnetic means to cover the yarn ducts of each of the entanglement nozzles.

In another illustrated embodiment, rows of entanglement nozzles are also arranged in parallel relationship and along opposite sides of each nozzle head. Opposite sides of each nozzle head taper inwardly toward each other in a cone-shaped configuration so that the sides of adjacent nozzle heads define a V-shaped opening therebetween. Wedge-shaped cover plates are positioned between adjacent nozzle heads and cover the yarn ducts of each of the entanglement nozzles.

The above-described embodiments of the present invention permit an adaptation to changed numbers of yarns, to exchange individual nozzle heads for dummy heads, and/or to exchange individual insertible nozzles for dummy inserts. To adapt the apparatus of the present invention to different numbers of yarns, the supporting frame to which the nozzle heads are attached, is adapted to pivot about a vertical axis. This permits the supporting frame to be adapted to the operating method of the draw system, on which the individual yarns are distributed, so that a greater or lesser number of entanglement nozzles or nozzle heads may be in operation.

Other objects and advantages will appear as the description proceeds, when considered in conjunction with the accompanying drawings, in which FIGS. 1A and 1B are somewhat schematic views of a draw system for a sheet of yarns, including one embodiment of air entangling apparatus therein;

Figure 14:
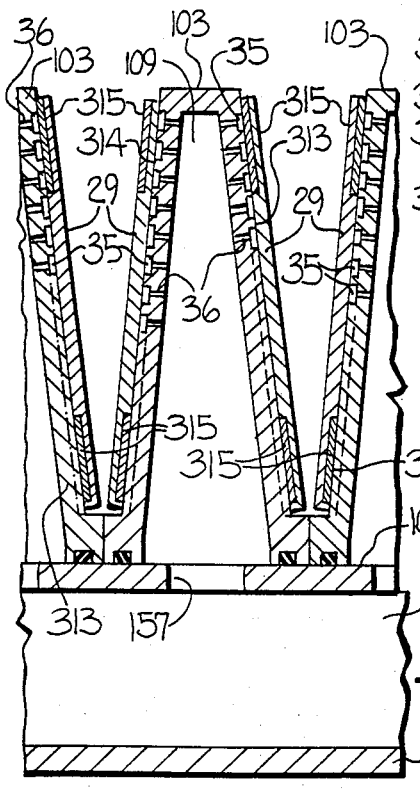
Figure 15:
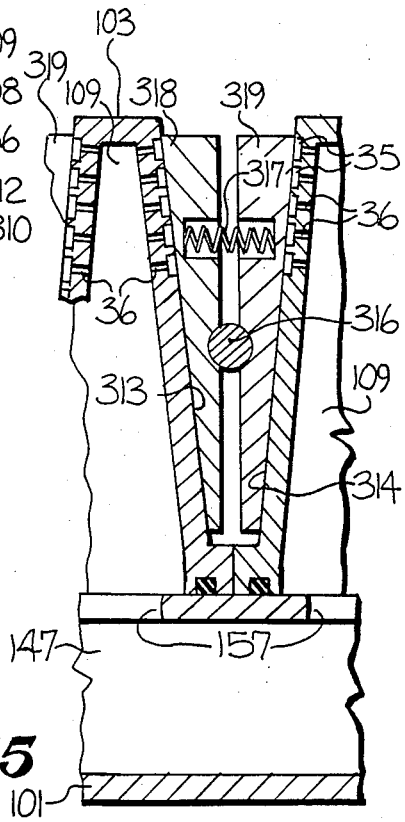

FIG. 14 is a vertical sectional view of another embodiment of the nozzle heads with rows of entanglement nozzles along opposite sides of each nozzle head, and with the cover plates being held in position by magnetic means; and FIG. 15 is a vertical sectional view of a further embodiment of the nozzle heads and with wedge-shaped cover plates of adjacent nozzle heads being held in position between opposite sides of adjacent nozzle heads.

Figure 1A:
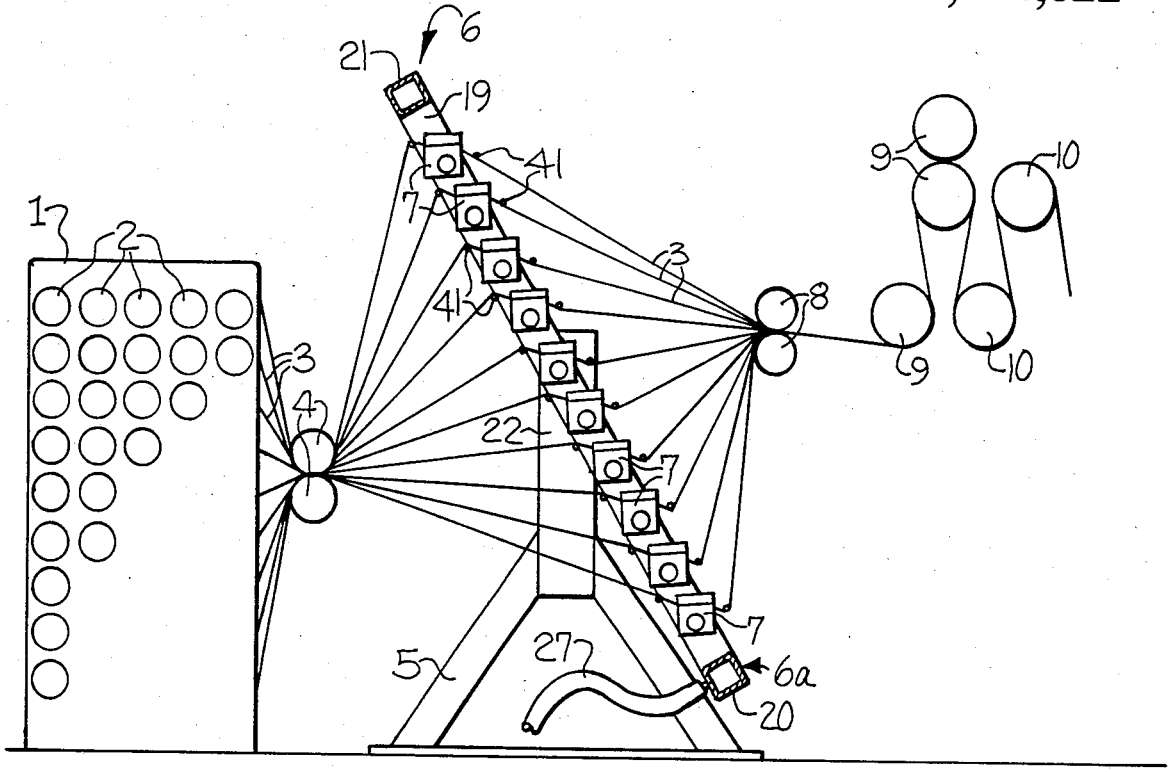
Figure 1B:
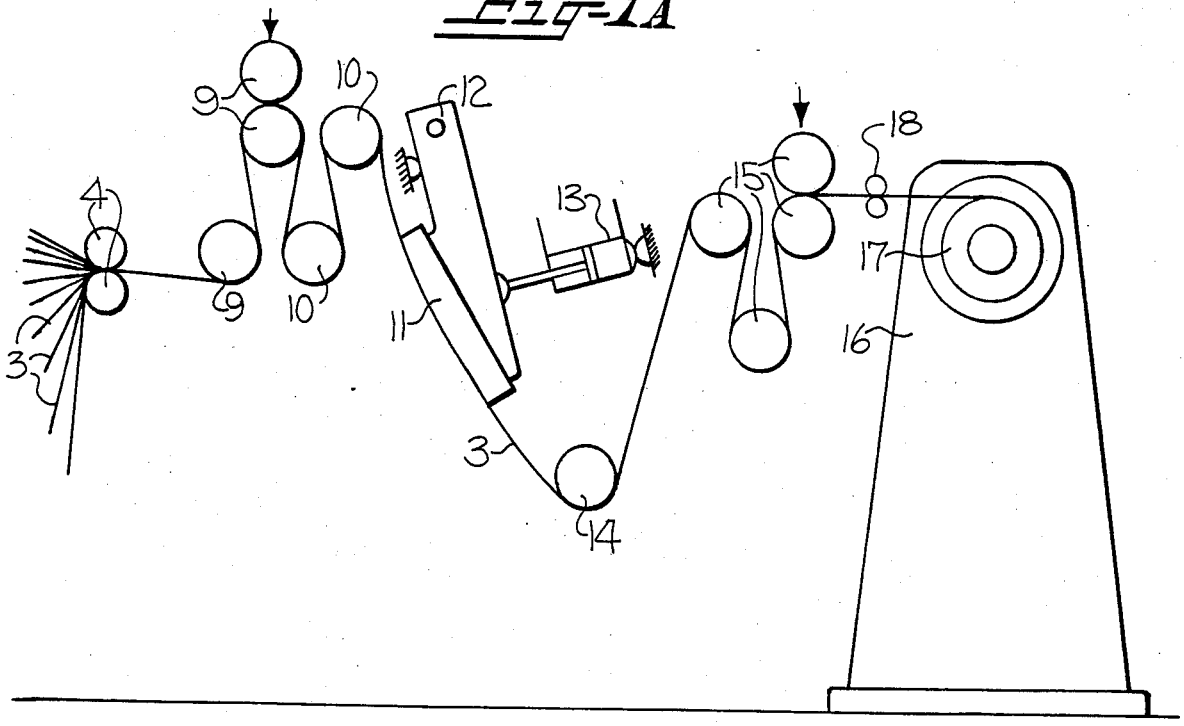

Referring more particularly to the drawings, FIGS. 1A and 1B schematically illustrate a preferred embodiment of an air jet entangling apparatus. As illustrated, the entangling apparatus, broadly indicated at 6, is shown in association with an apparatus for processing a warp sheet of yarns, and which includes a creel 1 adapted to accommodate a plurality of supply yarn packages 2, such as one thousand or more such packages. The yarns 3 are withdrawn from the packages and advanced by means of suitable yarn guides, yarn tensioners and yarn detectors, not shown. The yarns 3 are withdrawn by a first pair of rolls 4 and then fanned into groups or sheets of yarns and guided through the entangling apparatus 6 to simultaneously air jet entangle each of the individual yarns.

Figure 2:
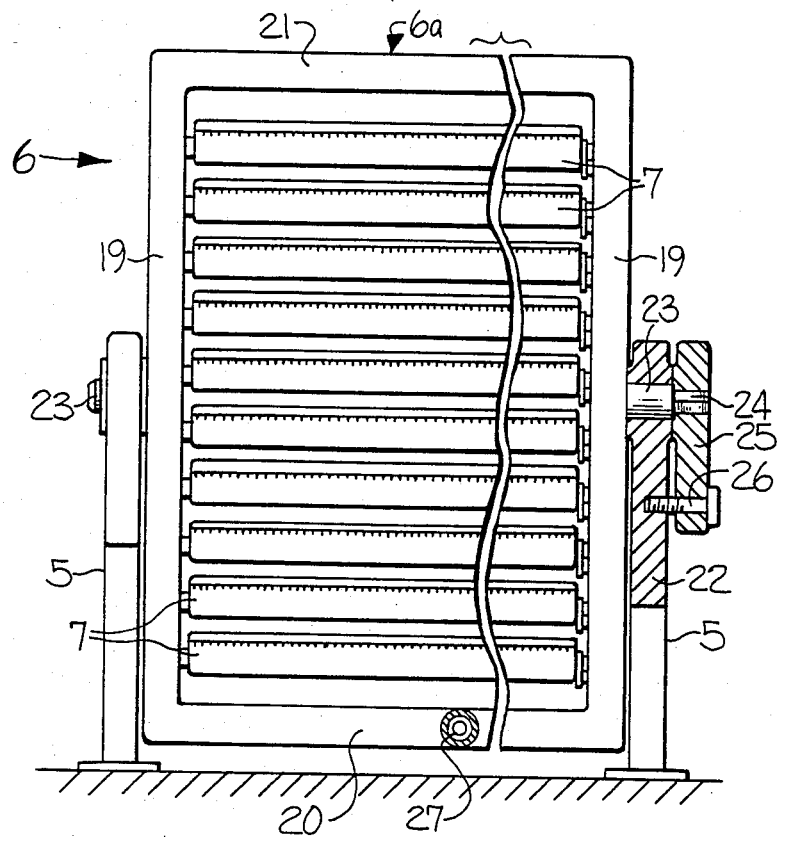
FIG. 2 is a front elevational view of the apparatus for air entangling the sheet of yarns.

The apparatus 6 includes a plurality of air jet beams 7 which are mounted on a supporting structure which includes a stand 5 and a rectangular frame 6*a*, as best seen in FIG. 2. The rectangular frame 6*a* includes two side members 19, a lower member 20, and an upper member 21. All of these members 19–21 are hollow, and the lower member 20 has an air supply line 27 connected thereto. The air jet beams 7 are horizontally disposed upon the frame 6*a*, and vertically spaced apart. In these air jet beams, the multifilament yarns 3 are respectively entangled in a socalled "entanglement nozzle," which improves yarn cohesion, i.e., the coherence of the individual filaments of each yarn, and which also improves the running properties and stretchability of the yarn.

Figure 3A:
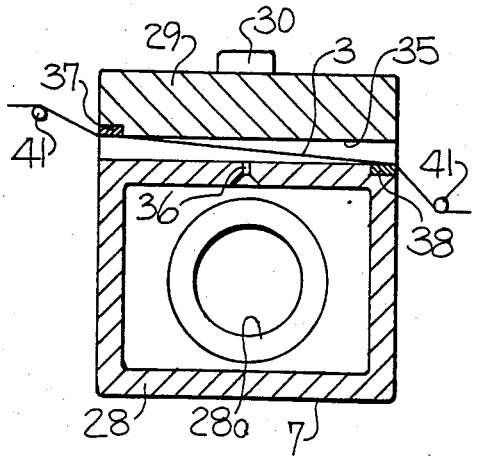
FIG. 3A is a transverse sectional view through one of the air jet beams of the apparatus of FIG. 2.
Figure 3B:
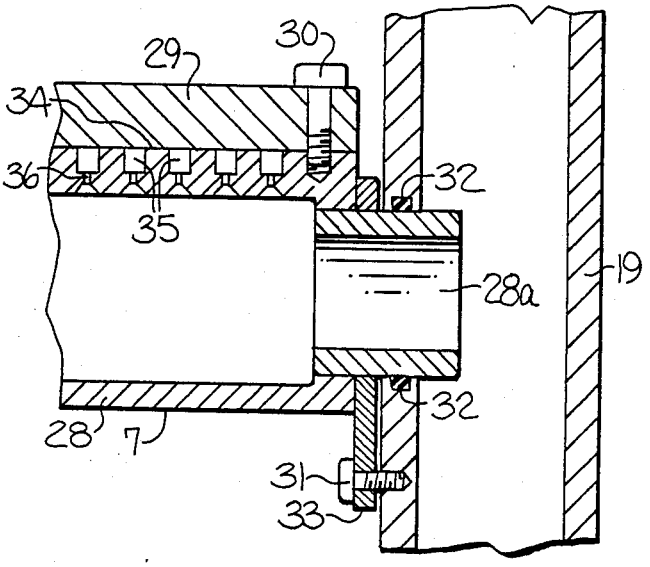
FIG. 3B is a fragmentary longitudinal sectional view of the end portion of one of the air jet beams.
Figure 4A:
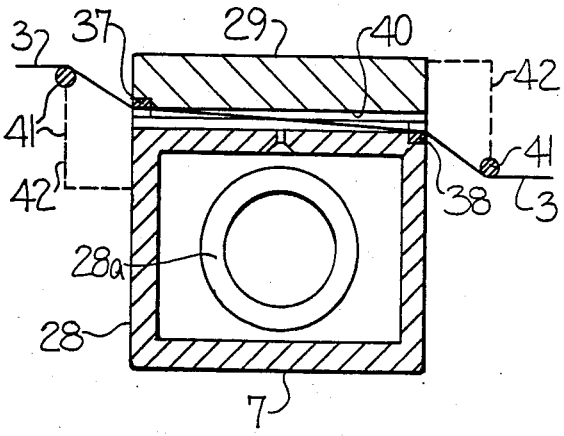
FIG. 4A is a transverse sectional view through another embodiment of an air jet beam.

The constructional details of the air jet beams 7 and rectangular frame 6*a* are illustrated in FIGS. 2–4. In the illustrated embodiment, each air jet beam 7 is preceded and followed by a guide rod 41 (FIG. 1A). These guide rods 41 may be connected with the air jet beam 7 in a suitable manner which is illustrated schematically by the dotted lines 42 in FIG. 4A.

After passing through the entangling ducts of the beams 7, the yarns 3 are reunited in a common plane, by passing through two guide rolls 8. The yarns 3 are then withdrawn by the feed rolls 9 of the draw system and pass around heated rolls 10. When polyester yarns are being processed, the rolls 10 are heated to about 90° C. The yarns 3 then travel over a hot plate 11 where they are heated to more than about 120° C. The hot plate 11 is pivotally mounted on a support bracket 12, and the plate 11 is adapted to be removed from the sheet of yarns by a pneumatic cylinder piston assembly 13. The assembly 13 may be controlled as a function of yarn detectors, not shown. A deflecting roll 14 is mounted downstream of the plate 11, and is followed by delivery rolls 15. The circumferential speed of the delivery rolls 15 is greater than the circumferential speed of the feed rolls 9, or the heated rolls 10, by the draw ratio. The sheet of yarns is then guided by means of a reed or comb 18 to a warp beam 17 of a beam winder 16.

The constructional details of the air entangling ducts of the present invention are illustrated in FIGS. 2–4. As seen in FIG. 2, the stand 5 is provided with vertical upper portions 22 which pivotally support opposite sides of the rectangular frame 6*a* for angular adjustment, by means of shafts 23 which extend outwardly from the opposite side members 19. The rectangular frame 6*a* may be pivoted by a square end section 24 extending outwardly from one of the shafts 23, and which mates with the upper end of a locking arm 25. The lower end of the locking arm 25 is adapted to be held in a selected pivoted position by means of a retaining pin 26.

In the embodiment of FIGS. 3A and 3B, each air jet beam 7 is in the form of a hollow beam section 28 which is rectangular in cross section and defines an internal air passageway. A hollow pivotal shaft 28*a* is mounted at each of the ends of the beam, and by this arrangement, each beam 7 is pivotally mounted for rotary adjustment in the inner side walls of the side members 19. A locking arm 33 is connected with the end of the beam 7 and permits the beam to be pivoted to the desired adjusted position relative to the frame 6*a*, and to retain the beam 7 in a desired pivoted position by a retaining pin 31. The shafts 28*a* are sealed to the side members 19 by seals 32, so that the interior of the beam 28 is in air communication with the interior of the side members 19, to which the pressurized air is supplied from the lower member 20 and the air supply line 27.

Each beam section 28 has a flat exterior upwardly facing surface which extends parallel to its longitudinal direction. An elongate cover plate 29 has a mating flat lower surface, and the cover plate is adapted to be positioned on the flat upper surface of the beam section 28. The two flat surfaces are accurately machined so that they rest upon each other at the interface 34 without forming a substantial gap. In its operating position, the cover plate 29 is releasably secured to the beam section 28 by retaining bolts 30.

A plurality of parallel channels 35 are cut into the flat upper surface of the beam section 28, with the channels extending transversely to the longitudinal direction of the beam 28 and being longitudinally spaced apart. An air jet aperture 36 communicates between the channels 35 and the interior of the beam section 28.

With the cover 29 positioned on the beam section 28 in the manner shown in FIGS. 3A and 3B, the channels 35 serve as yarn ducts, in which the advancing yarns 3 are air entangled. It has been found that the yarns 3 should be preferably guided diagonally through the entanglement ducts when viewed in a longitudinal section of the channels 35 (FIG. 3A). For this reason, the cover plate 29 has a yarn guide edge 37 at its entry end, and a yarn guide edge 38 is provided at the exit end of the beam section 28.

For the purpose of threading the yarns 3, the cover plate 29 may be removed from the beam section 28. A single yarn may then be readily placed in each channel 35. The guide bars 41 are positioned in front of and behind the air jet beam, and may be connected with the cover plate 29 and/or the beam section 28 in any suitable manner, the particular connections not being illustrated in FIGS. 3A and 3B.

As an alternative embodiment, the channels may be formed in the flat surface of the cover plate 29. In this case, the air jet apertures 36 terminate on the flat upper surface of the beam section 28. Similarly, it is possible to provide less deep channels in the flat surfaces of both the cover plate 29 and the beam section 28.

Figure 4B:
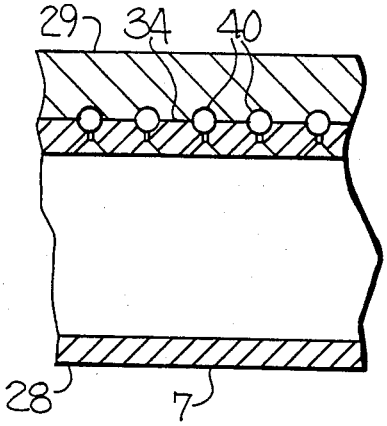
FIG. 4B is a fragmentary longitudinal sectional view of the air jet beam of FIG. 4A.

For air entangling certain yarns, it may be preferred to employ yarn ducts or channels of a circular cross section, and suitable circular ducts 40 are shown in FIGS. 4A and 4B. In this embodiment, the cover plate 29 and beam section 28 are tightly secured to each other, with their respective flat surfaces in mating overlying relationship. Further, the circular ducts 40 are formed at the interface 34, with the ducts 40 extending halfway into the cover plate 29 and halfway into the beam section 28. More particularly, the cover plate and beam section each include semicircular channel portions which mate with each other to form the circular yarn ducts 40 when the cover plate 29 is assembled to the beam section 28. Also, in the case of this embodiment, the yarn guides 37 and 38 are semicircularly shaped in cross section.

As will be understood, it may occasionally become necessary to put the drawing system illustrated in FIGS. 1A and 1B quickly out of operation. This may be required, for example, when one of the yarns 3 in the sheet breaks. In this event, it is desirable to prevent the other yarns of the sheet from being damaged by the heating means. As shown, this may be done on the one hand by lifting the hot plate 11 from the sheet of yarns. In addition, the present invention provides that the heated rolls 10, may be heated with a fluid and provided with a fluid circulation system, not shown, which includes valve means through which the heated fluid may be rapidly exchanged for an unheated fluid. These valve means may be operatively connected to a yarn monitoring system of the drawing apparatus. Water is a suitable hot fluid, since temperatures up to 100° C. are desired. Water is also suitable as a cold fluid, with cold being here understood to be a temperature at which the yarns resting on the rolls 10 are no longer damaged.

It should be noted that the surface speed of the rolls 10 may be adjusted independently of those of the rolls 9 or 15, which is known per se from the technology of drawing man-made filament yarns, and in particular, polyester yarns.

Figure 5:
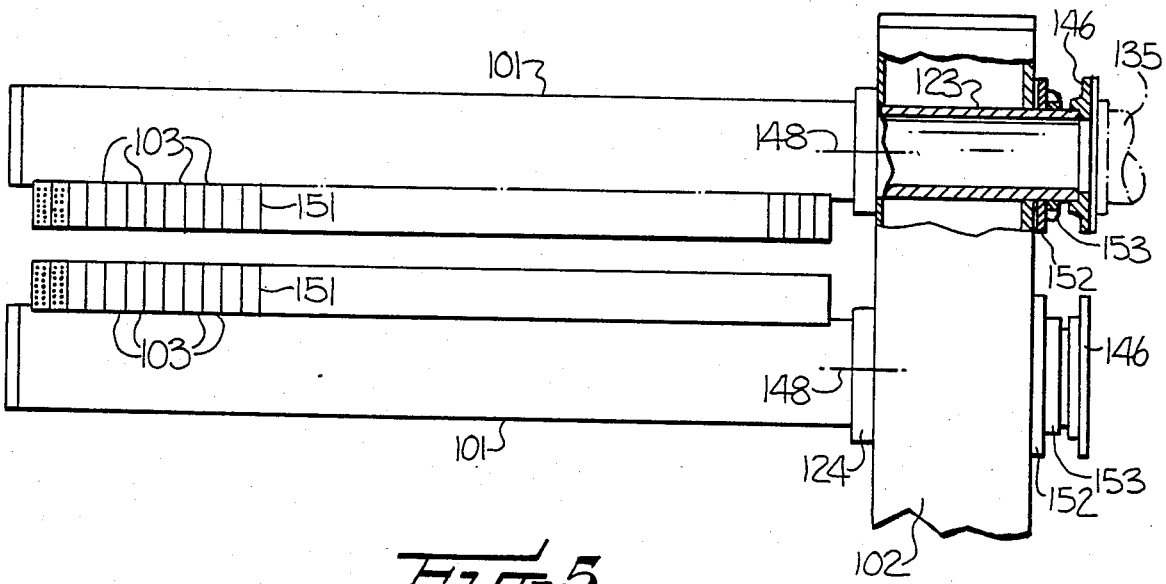
FIG. 5 is an embodiment of the apparatus with two air supply beams, each carrying one row of nozzle heads.

FIGS. 5–13 illustrate other specific embodiments of the yarn entanglement apparatus in accordance with the present invention. As shown in FIG. 5, air supply section beam 101 is provided with a projecting mounting end 123 supported in stand 102, and adapted to rotate about a longitudinal axis 148. Section beam 101 preferably extends essentially in a horizontal direction and a row 151 of closely packed nozzle heads 103 is mounted on one side of the air supply beam 101.

Figure 7A:
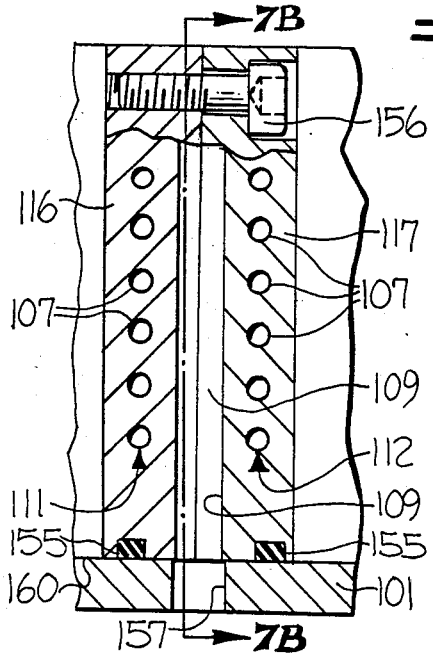
FIG. 7A is a longitudinal sectional view of another embodiment of a nozzle head.
Figure 7B:
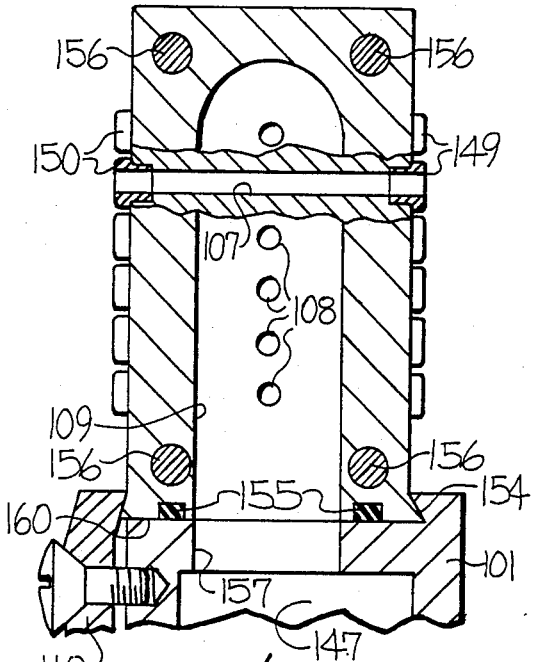
FIG. 7B is a vertical sectional view taken substantially along the line 7B—7B in FIG. 7A.

Each nozzle head 103 is a parallelepiped block which is penetrated by a plurality of entanglement nozzles. The axes of the entanglement nozzles are essentially perpendicular to the longitudinal axis 148 of the air supply beam 101. As shown in FIGS. 7A and 7B, each nozzle head 103 includes a system of hollow spaces and channels, through which each individual entaglement nozzle head 103 is supplied with compressed air. For this purpose, the central channel 109 of each nozzle head 103 is connected with the hollow interior 147 of the air supply beam. Each nozzle head 103 is sealed against the air supply beam 101, by a seal 155.

By means of a collar 124 and a ring nut 153 with a washer 152, each section beam 101 is rotatably mounted on the stand 102 by the hollow shaft 123. Each air supply beam hollow support shaft 123 extends through the stand 102 and is provided with a flange 146, which may be connected with air supply line 135, shown in dash-dot lines. In the embodiment of FIG. 5, two air supply beams 101 are mounted on stand 102 with their axes 148 extending parallel to each other. They are mounted so that the two rows 151 of nozzle heads 103 face each other, for reasons to be presently explained. Stand 102 is adapted to pivot about vertical axis 161, so as to be able to evenly distribute the yarns over the entire length of the air supply beam, even when the number of yarns is changed.

Figure 6A:
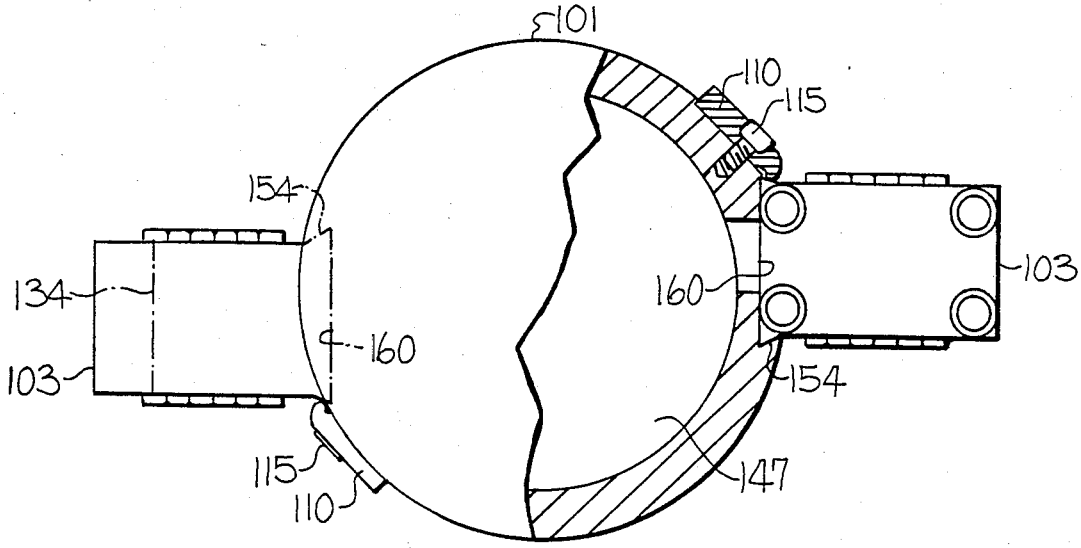
FIG. 6A is an end view, partly in cross section, of an air supply beam similar to the embodiment of FIG. 5 but including rows of nozzle heads on opposite sides thereof.
Figure 6B:
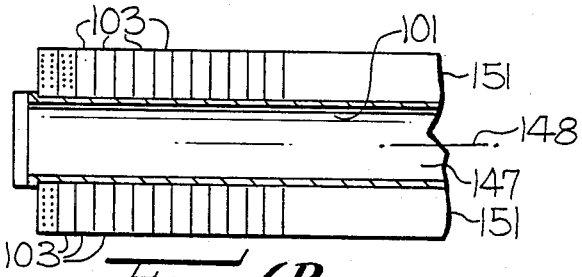
FIG. 6B is a fragmentary longitudinal sectional view of the air supply beam of FIG. 6A, with the two rows of nozzle heads displaced relative to each other by about 180°.

FIGS. 6A and 6B illustrate an embodiment in which two rows 151 of nozzle heads 103 are positioned on opposite sides of the section beam 101 and are displaced relative to each other by about 180°. FIG. 6A illustrates an air supply beam 101 with a round cross section. The air supply beam 101 has two flat surfaces 160 which extend in the longitudinal direction of the air supply beam and form, with the circumference of the air supply beam, a dovetailed recess 154. Each of the closely juxtaposed nozzle heads 103 is held in position against the dovetailed stop 154 by a clamping member 110 and a bolt 115. Rubber seals, not shown, provide an air-tight seal between the nozzle heads 103 and the air supply beam 101. It should be noted that the nozzle heads 103 in the embodiment of FIG. 5 may be held in position on their respective air supply beam 101 in the same way as illustrated in the embodiment of FIG. 6A.

The inside construction of the nozzle heads 103 of the present invention is shown in detail in the embodiment of FIGS. 7A and 7B, where the nozzle heads 103 are held in position on a rectangular hollow beam section 101. Nozzle head 103 essentially comprises two plates 116 and 117, which are held together by bolts 156 (FIG. 7A). Recesses are formed in the facing surfaces of the plates 116, 117 to provide a central chamber 109 which serves to supply air to air supply channels 108 communicating with bores forming air jet channels or ducts 107. Air is supplied through an opening 157 from the interior 147 of air supply beam 101. Each of plates 116, 117 has respectively one row 111, 112 of yarn entangling ducts 107. An air channel 108 leads from each yarn duct 107 into air supply chamber 109. With the aid of seals 155, each individual nozzle head is sealed against air supply beam 101.

In the illustrated embodiment of FIG. 7B, the yarn ducts 107 are arranged in planes which are perpendicular to surface 160 extending longitudinally along air supply beam 101. However, it is also possible to arrange the yarn ducts 107 in planes which form an angle of less than 90° with surface 160. As a result thereof, all yarn ducts and the yarns passing therethrough can be viewed vertically from above. Each yarn duct 107 is a bore which is drilled through the respective plates 116 or 117. Wear-resistant yarn guide inserts or eyelets 149, 150 are mounted at the respective entry and exit ends of the yarn duct 107.

Figure 8A:
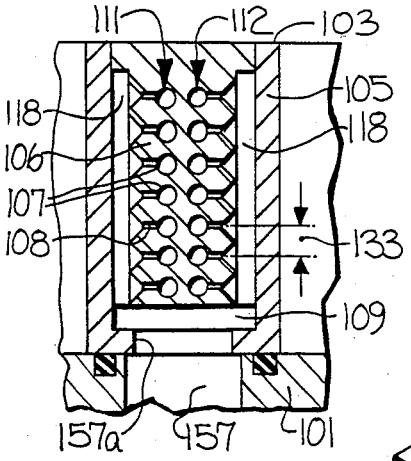
FIG. 8A is a longitudinal sectional view of an embodiment of the nozzle head with fourteen entanglement nozzles.
Figure 8B:
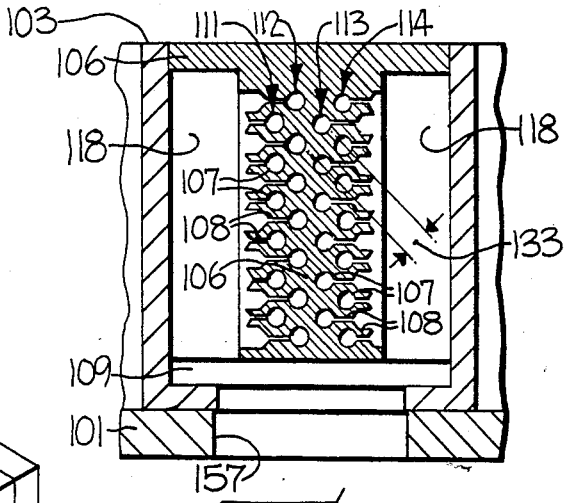
FIG. 8B is a longitudinal sectional view of an embodiment of the nozzle head with four rows of entanglement nozzles.

Two additional embodiments of the nozzle head 103 of the present invention are illustrated in FIGS. 8A and 8B. Both embodiments include a housing 105 and an insert 106 which is sealingly secured into housing 105. Housing 105 has a U-shaped cross section with a hole **157*a* in the bottom which is in alignment with a connecting opening 157 in the air supply beam 101. The two side walls and the bottom of the housing 105 form a parallelepiped interior which is open on the top and on the two sides. An insert 106 is shown mounted in the housing 105 in FIG. 8C. The insert 106 is a parallelepiped block which is fitted into the interior of housing 105 with opposite sides spaced inwardly from the side walls of housing 105 to form an air chamber 118 on each of the opposite sides of the insert 106. Furthermore, the bottom wall of insert 106 is spaced above the bottom wall of housing 105 to provide a recess 109 above the hole 157*a* in the bottom wall of the housing 105. The air chambers 118 are connected, by means of recess 109, hole 157*a* in the bottom of housing 105, and hole 157, with the interior 147 of the air supply beam 101. Yarn ducts 107 extend through the insert 106 in longitudinal direction, i.e., transversely to the longitudinal direction of the air supply beam 101. Air channels 108 extend perpendicular to the yarn ducts 107 and communicate with the air chambers 118 which, as above described, are connected with the interior 147 of the air supply beam 101**.

Figure 8C:
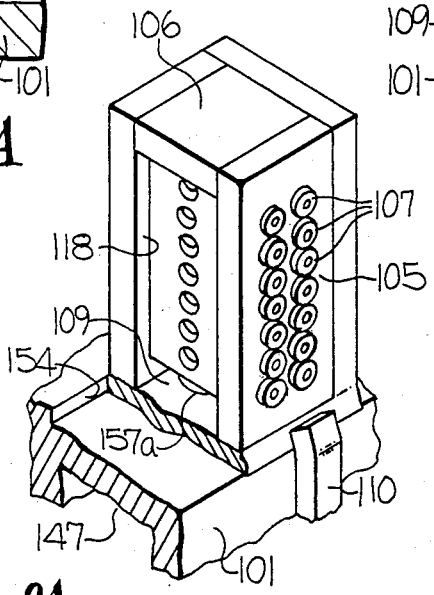
FIG. 8C is a fragmentary isometric view of the embodiment of the nozzle head of FIG. 8A.

As illustrated, the embodiment of FIGS. 8A, 8C has the yarn ducts 107 vertically aligned in two rows 111, 112. On the other hand, the insert 106 of FIG. 8B contains four rows 111–114 of yarn ducts 107. To achieve a greater duct density neighboring rows, such as rows 111, 112 of yarn ducts 107, are offset relative to each other so that the individual yarn ducts 107 are "staggered." As shown in FIG. 8B, the rows 112 and 114 each have seven yarn ducts 107 while rows 111 and 113 each have six yarn ducts 107.

Figure 9C:
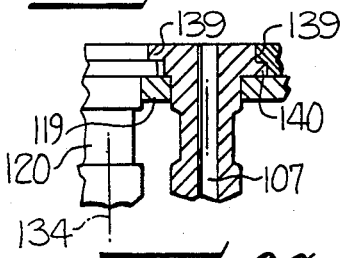
FIG. 9C is an enlarged fragmentary detail view, partly in cross section, of two adjacent nozzles of FIG. 9B.
Figure 9B:
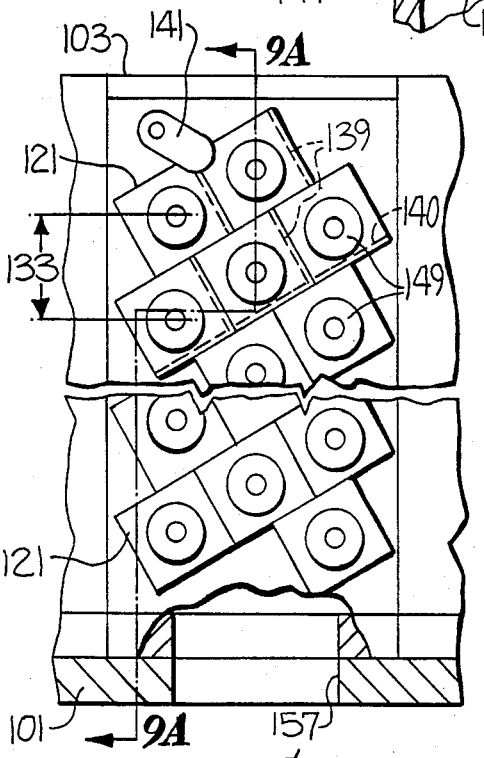
FIG. 9B is a fragmentary front elevational view looking at the left-hand side of the nozzle head of FIG. 9A.
Figure 9A:
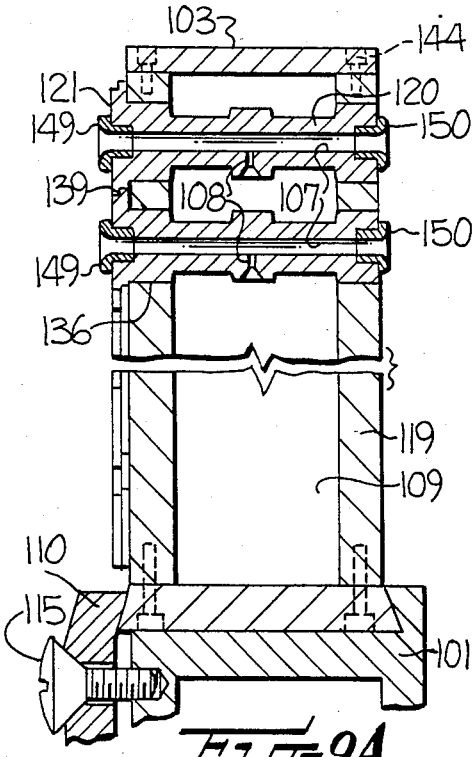
FIG. 9A is a sectional view of an embodiment of the nozzle head with insertible nozzles, taken substantially along the line 9A—9A of FIG. 9B.

FIGS. 9A and 9B illustrate a further embodiment of the nozzle head 103. A hollow, parallelepiped housing 119 is closed by cover 144 and includes an air supply chamber 109 between the side walls of the housing 119. Bores 136 extend through the side walls of the housing 119 and support individual entanglement nozzles, in the form of tubular nozzle inserts 120, therein. Each tubular nozzle insert 120 contains a radial air channel 108, which connects the air supply chamber 109 in the interior of housing 119 with the corresponding yarn duct 107. A suitable yarn entry guide 149 is fixed in the yarn entry end of each of the tubular nozzle inserts 120 and a yarn exit guide 150 is fixed in the exit end. Rectangular platelets 121 are provided on the entry ends of the nozzle inserts 120 and the side lengths are so dimensioned that they abut without interspace when the nozzle inserts 120 are inserted (FIG. 9B). It is preferred that one insert 120 cannot be removed and changed without removing a few of the inserts 120. For example, if two edges on the back side and two edges on the front side of each of the platelets 121 are stepped, as indicated at 139 in FIG. 9A, adjacent edges of the platelets 121 will overlap so that all of the platelets are held in assembled position by one pivoted latch 141 (FIG. 9B).

The nozzle heads 103 as shown in FIGS. 7–9 make it possible to vary the number of yarns which are simultaneously air jet entangled, within predetermined limits. For this purpose, a few nozzle heads 103 may be exchanged for dummies, when the nozzle heads 103 of FIGS. 7A, 7B or 9A–C, and one or more air jet beams 101, as shown in FIG. 5, are used. These dummies contain no entanglement nozzles or no air channels respectively, and serve only to seal the openings in the air jet beams 101. With the use of nozzle heads 103 as shown in FIGS. 8A–C, the inserts of a few nozzle heads of an air supply beam may be replaced with dummies, which serve again the purpose of sealing the openings of the air supply beam. By shutting down a few insert nozzles or nozzle heads an even distribution of the yarns over the entire working width of the draw system and the warp beam is ensured even with a lesser number of yarns. The inserted dummies, not shown, would have the same dimensions as the nozzle heads of FIGS. 7 or 9, or as the inserts of FIGS. 8A–C, respectively. With the use of nozzle heads of the type shown in FIGS. 9A–C, it is further possible to use dummies in the place of the nozzle inserts, which serve to seal the bores in the nozzle head.

It should be noted that for purposes of adapting the system to different numbers of yarns, the air supply beam 101 of respectively FIG. 5 or 6A may also be adapted to pivot about the axis 161, as shown in FIGS. 5, 6A and FIGS. 10, 11. This permits the yarn density to be adjusted, i.e., the yarns can be evenly distributed across the width of the warp yarn sheet. Here, it is also noted that the nozzle heads 103 may be rotated by rotating the air supply beam 101, so that when the air supply beam 101 is rotated about axis 161, the individual yarn ducts can be realigned in the desired manner with the yarn path.

Figure 11:
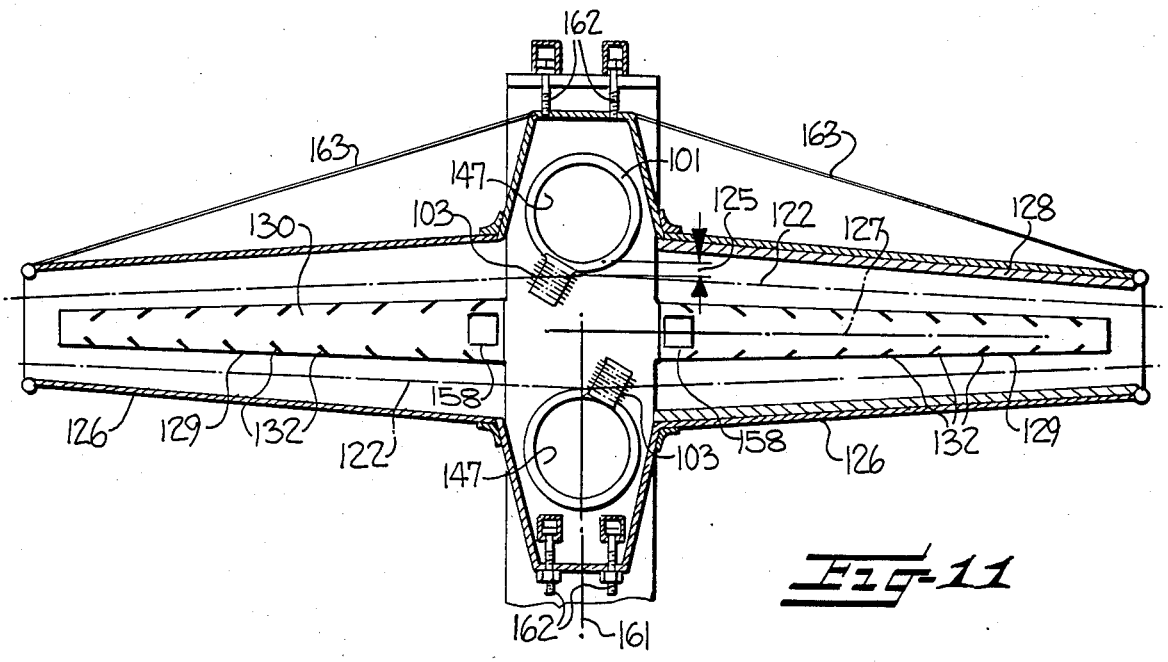
FIG. 11 is a longitudinal sectional view of a sound insulating and suction enclosure box.
Figure 12:
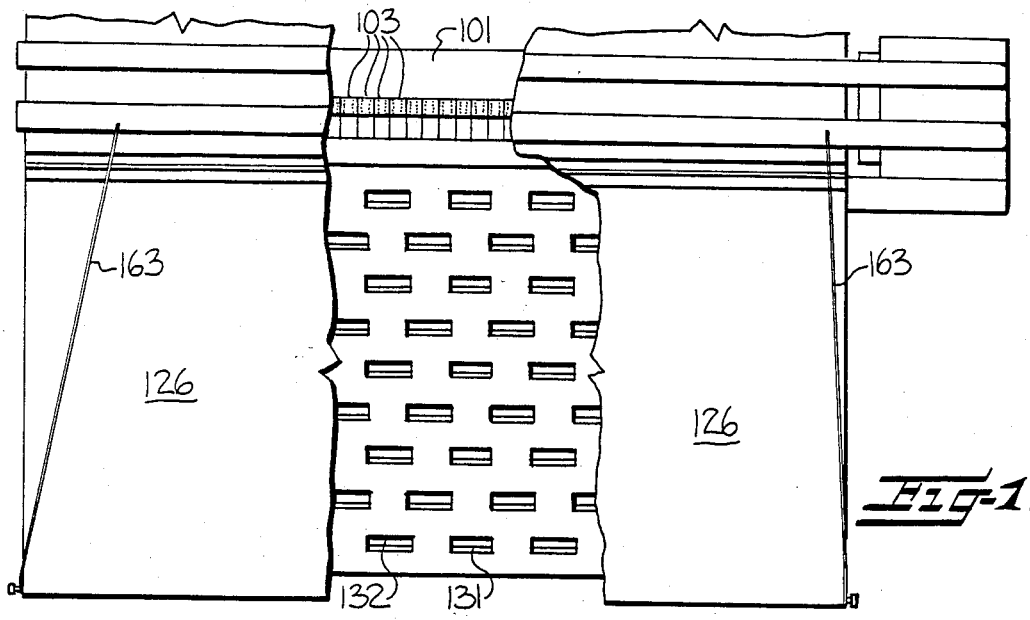
FIG. 12 is a fragmentary plan view of the righthand portion of the sound insulating and suction enclosure box of FIG. 11.

The present invention is also directed to avoiding environmental influences which proceed from the use of the apparatus for air entangling a plurality of yarns. An apparatus which avoids such environmental influences is shown in FIGS. 11 and 12. It is known that the air jet interlacing or entangling treatment of yarns usually produces an extraordinarily high noise generation. In addition, the air consumption is considerable in the air jet treatment of such a large number of individual yarns, and can no longer be disregarded with the use of air conditioning. As a result, the embodiment of FIGS. 11 and 12 is particularly directed to reducing the effects of these two factors.

The apparatus of FIGS. 11 and 12 for air entangling a plurality of yarns illustrates two air supply beams 101 with nozzle heads 103 mounted thereon, which corresponds to the apparatus of FIG. 5. As can be seen in FIG. 11, a box 126 encloses the entire working width of the air supply beams 101 and further extends outwardly on both sides and over a portion of the yarn paths, indicated by the dash-dot lines 122. In the right-hand portion of enclosure box 126, the inner sides are shown with a layer of sound-absorbing material 128 attached thereto. Other noise abating steps may be provided, such as, for example, components based on reflexion and/or interference.

A suction duct 129 is provided between the two air supply beams 101 and their associated yarn warp sheets 122 and extends outwardly along the medial portion of the enclosure box 126 and on each side of the air supply beams 101. These suction ducts 129 also extend over the entire operating width of the air supply beams 101 and essentially over the length of the enclosure box 126. The suction ducts 129 are connected to a suitable suction system by means of connector ducts 158. Each suction duct 129 is provided with suction orifices 131 (FIG. 12) which are provided with inwardly extending baffles 132. The baffles 132 are positioned at an angle so that they receive the air coming from the nozzle heads 103 and flowing toward the open ends of the enclosure box 126, and draw the air into the suction ducts 129. In the illustrated embodiment of FIGS. 11 and 12, the suction orifices 131 are formed in the walls of the ducts 129 by punching three sides inwardly so that the thus resulting baffles 132 are bent inwardly in an inclined manner. Both the enclosure box 126 and suction ducts 129 are essentially symmetrical to a central dash-dot line 127, as shown in FIG. 11.

In FIG. 11, both air supply beams 101 are rotated clockwise from the vertical plane. As a result, the warp sheets of yarns, indicated by the dash-dot lines 122, are displaced on the entry side relative to the exit side by an amount illustrated by the dimension line 125. Since the favorable deflection angle for the passage of the yarns through the ducts is adjustable and dependent on the individual yarn and process parameters, the upper cover and the lower cover of the enclosure box 126 are adjustable in height. For this purpose, adjustable mountings 162 are provided in the form of threaded spindles, as illustrated in FIG. 11. Retaining wires, indicated at 163, are provided for supporting the outer ends of the enclosure box 126.

Figure 10:
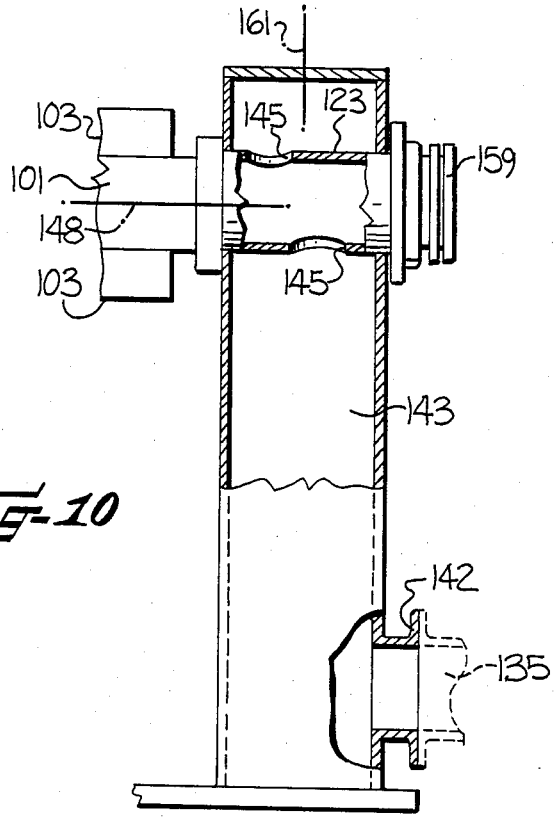
FIG. 10 is a fragmentary, cross-sectional view of the stand for the apparatus of FIGS. 5–9B with portions thereof being broken away.

FIG. 10 illustrates a hollow stand 102 for supplying air which differs from that shown in FIG. 5. Here a flange connection 142 for the air connection 135 is located on the lower portion of the stand 102. The end of the hollow support shaft 123 of the air supply beam 101 is closed by a cover 159 and includes inlets 145 for the transfer of air from the stand 102 to the air supply beam 101.

Since the number of yarns 3 in the warp sheets 122 is variable, the number of nozzle heads 103 which may be mounted on air supply beams 101 is adapted to the maximum number of yarns. An adaptation to the respective actual number of yarns can, in the apparatus of the present invention, be easily achieved in that the individual nozzle heads or insertible nozzles may be replaced with dummies. As shown in FIGS. 5 and 6B, it is possible to place the individual entanglement nozzles very close together, with spacings of 2–3 mm between neighboring yarn ducts being the preferred dimensions. As a result, it is possible, for example, with the use of nozzle inserts 106, according to FIG. 8B, to accommodate a warp sheet with a large number of yarns in just one row 151 of nozzle heads 103. The yarns may be threaded into the individual entanglement nozzles by means of threading wires or hooks Pneumatic threading of yarn into the nozzles may also be effected if the air channels 108 are oriented at an acutue angle with respect to the yarn duct 107, and such that a suction is created at the inlet end of the yarn duct 107. It is also possible to include specific additional air ducts (not shown) for generating the suction.

Figure 13:
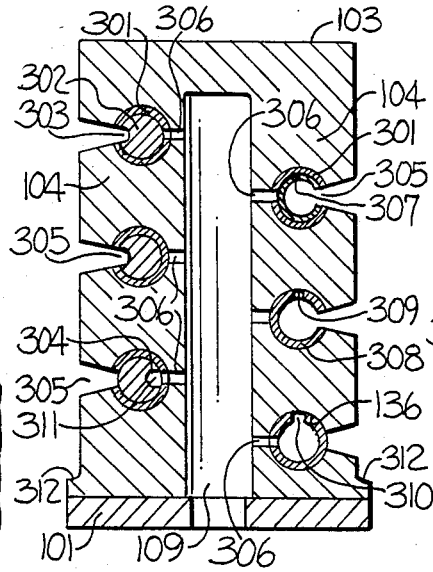
FIG. 13 is a vertical sectional view of an embodiment of a nozzle head with yarn threading slots.

An embodiment of a nozzle head 103 with three different threading means is illustrated in FIG. 13. The common feature of these three threading means is that the nozzle head 103 is constructed as a housing which, as described in conjunction with FIGS. 7A, 7B, is composed of plate 104 which includes the central air chamber 109 therein. The nozzle head 103 contains bores 136 with threading slots 305 which open to the side surfaces of the nozzle head 103.

First, reference is made to the left-hand vertical row of nozzles. A slotted tube 301 is fixed in the housing bore 136 with its slot aligned with the threading slot 305 of bore 136. A rotatable cylindrical inner member 302 is positioned in tube 301, and has a rectangular groove 303, or a rounded groove 304, extending axially along the outer surface and along the entire length of the inner member 302. To thread the yarn, the inner member 302 is rotated so that grooves 303 or 304 and threading slot 305 are aligned. The yarn, indicated at 311, is placed in the grooves 303 or 304 and the inner member 302 is rotated until the air channel 306 is aligned with the grooves 303 or 304. The inserted yarn 311 is thus rotated to the operational position by the rotation of inner member 302.

Another version of a threadable entanglement nozzle is shown in the upper right-hand portion of FIG. 13. A slotted tube 301 is fixed in the nozzle bore 136 with its slot in alignment with the threading slot 305 of nozzle head 103. An inner tube 307 is supported for rotation in the tube 301. In the illustrated position, the slot of the inner tube 307 is aligned with the threading slot 305 of the nozzle head 103 so that the yarn can be inserted into inner tube 307. By rotating inner tube 307, the threading slot 305 is closed, and the slot of the inner tube is moved into alignment with air channel 306.

A simplified version is illustrated by the two lower right-hand nozzles of FIG. 13. In both of these examples, the outer tube 301 is eliminated and only a single tube 308 is supported for rotation in the housing bore 136. The tube 308 has a slot 310 extending over its length and serving to thread a yarn. The tube 308 also is provided with an air channel 309 which is located in 90° relationship with the lengthwise slot 310. In the threading position of the tube 308, slot 310 is aligned with threading slot 305 of nozzle head 103 so that a yarn can be easily placed therein. In operating position, air channel 309 of the tube 308 is aligned with air channel 306 and lengthwise slot 310 of the tube 308 is in a vertical position and covered by the wall of bore 136. The middle right-hand nozzle of FIG. 13 is shown in the threading position while the lower right-hand nozzle is shown in operating position.

To make space for a lateral threading of the yarn, adjacent nozzle heads 103 are spaced apart in the area in which the threading slots 305 are located. Accordingly, each nozzle head 103 has lateral widened portions 312 at each side of the bottom portion. The nozzle head 103 illustrated in FIG. 13 may be secured to the air supply beam 101 by a dovetailed joint and a clamping member of the type shown in FIG. 6A. One advantage of the nozzle head of the type shown in FIG. 13 is that the yarns can be easily inserted. Another advantage is that the entanglement nozzles can be individually cut off from the air supply by rotating the inner member 302, inner tube 307, or tube 308. Thus, the use of a nozzle head of the type shown in FIG. 13 enables a particularly simple adaptation of the entanglement apparatus to the desired number of yarns.

FIG. 14 is a fragmentary vertical sectional view of another embodiment of adjacent nozzle heads 103 with yarn guiding grooves or ducts 35 and plates 29 for covering the yarn entanglement nozzles. The nozzle heads 103 are fixed to the air supply beam 101 in the same manner as shown, for example, in FIGS. 6A and 7B. Each nozzle head 103 defines an upwardly extending wedge-shaped body with inwardly tapering opposite side walls 313, 314. The nozzle head 103 is closed at its front and rear ends and air is supplied through an opening 157 from the interior 147 of the air supply beam 101 to the central chamber 109. The side walls of adjacent nozzle heads 103 define V-shaped openings therebetween and parallel grooves 35 are provided in the outer surfaces of each side wall. The grooves or yarn ducts 35 are connected by means of air ducts 36 to the central chamber 109 of the nozzle head 103. The plates 29 each have an inner surface matching with the outer surface of the side walls 313, 314 and tightly close the grooves 35 and to thereby form air jet nozzles.

Means is provided for tightly fastening the closure plates 29 to the side walls 313, 314. The fastening means includes magnets 315 which are fixed in the plates 29 and form a smooth surface contact with the outer surfaces of the side walls 313, 314. It is to be understood that the magnets 315 may be arranged in the side walls 313, 314 of the nozzle head 103 or the magnets 315 may be arranged in both the plates 29 and in the side walls 313, 314. For threading the yarns into the yarn duct grooves 35, the Plates 29 are removed from the nozzle head 103. The wedge-shaped arrangement of the side walls 313, 314 causes the grooves 35 to be arranged in inclined planes, so that the operator can easily see each groove 35 when looking from the top of each nozzle head 103.

Another embodiment is shown in FIG. 15 with an alternative type of cover plate 318, 319. Adjacent air jet nozzle heads 103 are fixed on the air jet beam 101. The nozzle heads 103 each have an opening 157 to connect their central chamber 109 to the interior 147 of the air supply beam 101. Each of the nozzle heads 103 has an upwardly extending wedge-shaped body and inwardly tapering side walls 313, 314. Grooves or ducts 35 are formed in the outer surfaces of the side walls 313, 314. These grooves 35 are connected by means of air inlet ducts 36 to the central air chamber 109 of each of the nozzle heads 103.

By arranging the nozzle heads 103 close to each other, a V-shaped opening is formed between neighboring side walls 313, 314 adjacent nozzle heads 103. The closing means for the ducts 35 is formed by a wedge-shaped closure member which includes two closing plates 318 and 319. The outer walls of the closing plates 318, 319 taper inwardly at the same angle and mate with the outwardly tapering side walls 313, 314. A pivot rod 316 engages semicircular grooves in the medial portions of the adjacent inner walls of the closure plates 318, 319. The size of the pivot rod 316 and the thickness of the plates 318, 319 is such that the outer surfaces of plates 318, 319 mate with the outer surfaces of the side walls 313, 314 and are tightly pressed against each other. Space is provided between the inner surfaces of plates 318, 319 so that limited pivotal movement is provided around the pivot rod 316, in order that the plates 318, 319 may adjust themselves to the inclination of the outer surfaces of the side walls 313, 314. Tension springs 317 are fixed at opposite ends to each of the plates 318, 319 and keep the plates 318, 319 together, when they are removed from the V-shaped opening or gap between two adjacent nozzle heads 103.

In the drawings and specification, there has been set forth several embodiments of the invention, and although specific terms are employed, they are used in a generic and descriptive sense only and not for purposes of limitation, the scope of the invention being defined in the claims.

That which we claim is:

1. An apparatus for simultaneously air jet entangling a plurality of advancing multifilament yarns, and which is adapted for use in association with the drawing and warp beaming of such yarns, and comprising an elongate air jet beam, said air jet beam including a longitudinal air supply passagway extending along its length, a plurality of individual air jet nozzle heads releasably mounted in a row along said air jet beam, and with said heads being mounted only to said beam and being disposed in a closely spaced relationship therealong, and each of said air jet nozzle heads including a plurality of individual yarn entanglement nozzles and a central air chamber communicatively connected with said individual yarn entanglement nozzles and said air supply passageway so that air passes from said air supply passageway, through said central air chamber, and into said individual yarn entanglement nozzles to engage and air jet entangle individual yarns passing through said yarn entanglement nozzles.

2. An apparatus according to claim 1 wherein each of said yarn entanglement nozzles comprises an elongate yarn duct through which the yarn passes, and wherein said elongate yarn ducts of each of said air jet nozzle heads extend parallel to each other.

3. An apparatus according to claim 2 wherein said yarn entanglement nozzles are arranged in at least one row in each of said air jet nozzle heads, and wherein the space between adjacent elongate yarn ducts is within the range of from about 1.5 mm to 15 mm.

4. An apparatus according to claim 1 wherein said air jet nozzle heads are supported in a single row along one side of said air jet beam.

5. An apparatus according to claim 1 wherein said air jet nozzle heads are supported in rows on opposite sides of said air jet beam.

6. An apparatus according to claim 1 including a support frame, and including means on at least one end of said air jet beam for supporting the same for rotational positioning on said support frame.

7. An apparatus according to claim 1 wherein each of said air jet nozzle heads includes at least six closely spaced entanglement nozzles.

8. An apparatus according to claim 1 wherein each of said air jet nozzle heads includes a housing, an insert supported in said housing, and a plurality of parallel bores extending through said insert and forming a yarn passage duct in each of said individual yarn entanglement nozzles.

9. An apparatus according to claim 8 wherein said bores in said insert are positioned in two rows of at least six bores each, and wherein said bores extend in planes parallel to each other.

10. An apparatus according to claim 9 wherein said bores in adjacent rows are offset from each other.

11. An apparatus according to claim 8 wherein said bores are formed in four parallel rows, and wherein said bores of adjacent rows are offset from each other.

12. An apparatus according to claim 1 wherein each of said air jet nozzle heads includes a pair of parallel plates, a row of bores formed in each of said plates and providing yarn passage ducts in each of said individual yarn entanglement nozzles, said central air chamber extending between said parallel plates, and air channels connecting said central air channel with said bores.

13. An apparatus according to claim 1 wherein each of said air jet nozzle heads includes a hollow housing having opposite side walls, and aligned pairs of bores formed in said opposite side walls of said hollow housing, and wherein each of said yarn entanglement nozzles includes an individual tubular nozzle insert supported in one of said pair of aligned bores and extending therethrough, and an air channel extending in a radial direction into each of said nozzle inserts, and means for supplying air to the interior of said hollow housing of each of said nozzle heads.

14. An apparatus according to claim 13 including a rectangular platelet fixed on one end of each of said individual nozzle inserts, and wherein adjacent edges of said rectangular platelets are positioned so that the adjacent platelets abut each other without interspace.

15. An apparatus according to claim 14 wherein said rectangular platelets include indented edges to provide a mutual overlap when assembled, and including a single clamp lever supported on said housing to engage one of said platelets and thereby maintain all of said platelets and associated insertible nozzles in position.

16. An apparatus according to claim 1 including a support frame, and wherein said air jet beam is supported on said support frame, and an air supply line directly connected to said air jet beam.

17. An apparatus according to claim 1 including a hollow support frame, wherein said air jet beam is supported on said hollow support frame with the air supply passage thereof in communication with the interior of said hollow support frame, and an air supply line connected to said hollow support frame for directing air into said air jet beam.

18. An apparatus according to claim 1 including two rows of nozzle heads positioned in substantially 180° relationship to each other and extending along opposite sides of said air jet beam.

19. An apparatus according to claim 1 including an enclosure box surrounding said air jet beam and extending across a portion of the yarn path at the entry and exit sides thereof, sound absorbing means on the inner surface of said enclosure box, and a suction system provided on the interior of said enclosure box for removing air exhausted from said yarn entanglement nozzles.

20. An apparatus according to claim 19 wherein said enclosure box includes spaced-apart upper and lower walls, and including means for vertically adjusting the distance between said upper and lower walls.

21. An apparatus according to claim 1 including a pair of said air jet beams disposed in a parallel arrangement, and wherein a row of said closely spaced air jet nozzle heads is mounted on each of said beams in opposing relationship.

22. An apparatus according to claim 1 wherein each of said air jet nozzle heads includes parallel bores extending therethrough, a threading slot communicating between the outer portion of said nozzle head and said bore, branch air channels connecting said central air chamber with said bores, and a cylindrical member supported for rotation in said bore and including longitudinal groove means therein, said cylindrical member being rotatable between a threading position with said groove means communicating with said threading slot and an operating position covering said threading slot and providing a yarn duct therethrough.

23. An apparatus according to claim 22 wherein said cylindrical member includes an outer tube fixed in said bore and including a slot in alignment with said threading slot, and an inner tubular member having a longitudinal slot which may be rotated into alignment with said threading slot and rotated out of alignment therewith to close the yarn duct.

24. An apparatus according to claim 22 wherein said cylindrical member comprises a single rotatable tubular member supported for rotation in said bore and including a longitudinal slot movable into and out of alignment with said threading slot.

25. An apparatus according to claim 22 wherein said cylindrical member comprises an outer tube fixed in said bore and including a longitudinal slot in alignment with said threading slot, and a cylindrical inner rod with a longitudinal groove therein adapted to be moved into and out of alignment with said threading slot.

26. An apparatus according to claim 25 wherein said groove in said rotatable cylindrical inner rod is rectangular in cross section.

27. An apparatus according to claim 25 wherein said groove in said cylindrical inner rod is rounded in cross section.

28. An apparatus according to claim 1 wherein each of said air jet nozzle heads includes a plane outer surface having grooves forming elongate yarn ducts therein, each of said yarn ducts being connected to the central air chamber in said nozzle head and being arranged parallel with the direction of the yarn passing therethrough, a cover plate extending over said yarn ducts, and closing means associated with said cover plate for maintaining said cover plate in tight engagement with said outer surface and covering said yarn ducts to thereby form individual yarn entanglement nozzles.

29. An apparatus according to claim 28 wherein said closing means comprises magnets.

30. An apparatus according to claim 28 wherein each of said air jet nozzle heads includes inwardly tapering opposite side walls defining an upwardly extending wedge-shaped body having a conical cross section, said side walls of adjacent of said air jet nozzle heads defining a V-shaped opening therebetween, and wherein said closing means comprises a wedge-shaped closure member positioned in and matching the V-shaped opening between adjacent nozzle heads to thereby close said yarn ducts.

31. An apparatus according to claim 30 wherein said wedge-shaped bodies each comprise a pair of closing plates, and a pivot rod positioned in the medial portion and between said pair of closing plates so that said closing plates mate with said outer surfaces of said side walls of adjacent nozzle heads and tightly close said yarn ducts therein.

* * * * *